US005244108A

United States Patent [19]

Hale

[11] Patent Number: 5,244,108

[45] Date of Patent: Sep. 14, 1993

[54] COLLAPSIBILE BULK CONTAINER AND METHOD OF MAKING THE SAME

[75] Inventor: James A. Hale, Red Bank, N.J.

[73] Assignee: Greif Bros. Corporation, Delaware, Ohio

[21] Appl. No.: 927,866

[22] Filed: Aug. 10, 1992

Related U.S. Application Data

[63] Continuation of Ser. No. 665,329, Mar. 6, 1991.

[51] Int. Cl.[5] ..... B65D 6/00

[52] U.S. Cl. ..... 220/4.33; 220/410; 220/466; 220/468; 220/610; 220/635; 220/636; 220/685; 220/686; 220/DIG. 25; 206/596; 206/600; 229/4.5; 229/23 R; 229/93; 229/198.3; 229/199

[58] Field of Search ..... 220/4.08, 4.09, 4.28, 220/4.33, 408, 410, 466, 468, 633, 634, 635, 636, 666, 685, 686, DIG. 25, 610, 612, 625; 206/596, 600, 386; 229/4.5, 23 R, 198.3, 199, 93

[56] References Cited

U.S. PATENT DOCUMENTS

| | | | |
|---|---|---|---|
| 1,045,944 | 12/1912 | Byrd . | |
| 1,265,932 | 5/1918 | Maltby | 229/93 |
| 1,482,926 | 6/1922 | Hillyard . | |
| 1,500,917 | 7/1924 | Bell | 220/4.09 |
| 1,511,915 | 10/1924 | Sherk | 229/93 X |
| 1,696,112 | 8/1927 | George . | |
| 1,752,134 | 5/1928 | Woodman . | |
| 1,907,797 | 5/1933 | Halle | 220/466 |
| 3,042,288 | 7/1962 | Carpenter, Jr. | 229/4.5 |
| 3,266,656 | 8/1966 | Kridle | 220/4.28 |
| 3,291,362 | 12/1966 | Sproull et al. | 220/4.09 X |
| 3,739,833 | 6/1973 | Rausch et al. | 220/685 X |
| 3,770,186 | 11/1973 | Kupersmit | 229/23 R |
| 3,974,616 | 8/1976 | Beckley | 220/4.28 X |
| 3,982,681 | 9/1976 | Graves et al. | 229/4.5 |
| 4,046,306 | 9/1977 | Cass | 229/5.7 |
| 4,050,604 | 9/1977 | Flanders | 220/4.28 |
| 4,157,147 | 6/1979 | DeForest et al. | 220/455 |
| 4,380,314 | 4/1983 | Langston, Jr. et al. | 220/468 X |
| 4,595,137 | 6/1986 | Kupersmit | 229/199 X |
| 4,606,461 | 8/1986 | Bolton, Sr. | 206/600 |
| 4,609,120 | 9/1986 | Lauer . | |
| 4,643,314 | 2/1987 | Kidd | 206/600 |
| 4,673,087 | 6/1987 | Webb | 206/600 |
| 4,729,505 | 3/1988 | Remaks et al. | 229/4.5 X |
| 4,793,507 | 12/1988 | Delphanque | 217/13 |
| 4,807,808 | 2/1989 | Reed . | |
| 4,863,024 | 9/1989 | Booth | 206/386 |
| 4,881,683 | 11/1989 | Linnemann | 229/117.01 |
| 4,949,898 | 8/1990 | Nederveld | 229/117.02 |
| 5,000,372 | 3/1991 | Hollander et al. | 229/23 R |
| 5,022,553 | 6/1991 | Pontius | 220/410 |

FOREIGN PATENT DOCUMENTS

| | | | |
|---|---|---|---|
| 2079254 | 1/1982 | United Kingdom | 206/596 |

*Primary Examiner*—Allan N. Shoap
*Assistant Examiner*—Stephen Cronin
*Attorney, Agent, or Firm*—Kane, Dalsimer, Sullivan, Kurucz, Levy, Eisele and Richard

[57] ABSTRACT

A collapsible, fiber, bulk container which is made-up of a plurality of sidewalls joined by connectors to form a tubular body. The body is closed off by top and bottom members telescopically engaging said body. The bottom may be reinforced by a strut member to insure that the bottom does not warp and collapse. A reinforcing strap is also secured around the body.

8 Claims, 3 Drawing Sheets

COLLAPSIBILE BULK CONTAINER AND METHOD OF MAKING THE SAME

This is a continuation of copending of copending applications Ser. No. 07/665,329 filed on Mar. 6, 1991, now abandoned.

BACKGROUND OF THE INVENTION

A. Field of Invention

This invention pertains to a bulk container for shipping and storing various goods, and more particularly to a fiber container which can be made to be dismantled, or collapsed, and reassembled at will when not in use, to save space.

B. Description of the Prior Art

Containers are the predominant means of shipping various goods, including materials in a liquid, or semi-liquid or powder form. Recently, it has been discovered that containers made of several laminated fiber layers are particularly useful for this purpose because they are relatively light, yet strong enough to hold various kinds of materials securely. Moreover, several such containers can be stacked vertically. In particular, fiber drums having substantially rectangular cross-sections with rounded corners have been found to be very advantageous, because this shape makes the containers very strong. A further advantage of these containers is that their tops can be easily stored therein without distortion, while the containers are not in use.

One problem with the containers presently used in the industry is that when they are empty they occupy a large amount of space, they are difficult to handle, and expensive to ship. Although metal drums and other types of containers are known which can be disassembled, so far no collapsible fiber containers have been suggested in the art which have proved to be satisfactory.

OBJECTIVES AND SUMMARY OF THE INVENTION

In view of the above-mentioned disadvantages of the prior art, it is an objective of the present invention to provide a fiber container which is easily collapsible to save space, and which can be easily assembled, without special tools.

A further objective is to provide a collapsible fiber container with means for reinforcing its bottom to allow handling using mechanized machinery.

Yet a further objective is to provide a container which is strong so that it can be used for large amounts of liquids or other materials.

Other objectives and advantages of the invention shall become apparent from the following description of the invention. A collapsible drum constructed in accordance with this invention includes several sidewalls which are joined together by connectors to form a tubular body. A bottom member is formed separately with a bottom plate and a peripheral skirt. The bottom member is inserted telescopically over the tubular body. A top member is similarly formed separately from a plate and a peripheral skirt and telescopically mounted over the body. The body may be made of two separate sections, one section being disposed inside the other.

DETAILED DESCRIPTION OF THE INVENTION

Figure 1:
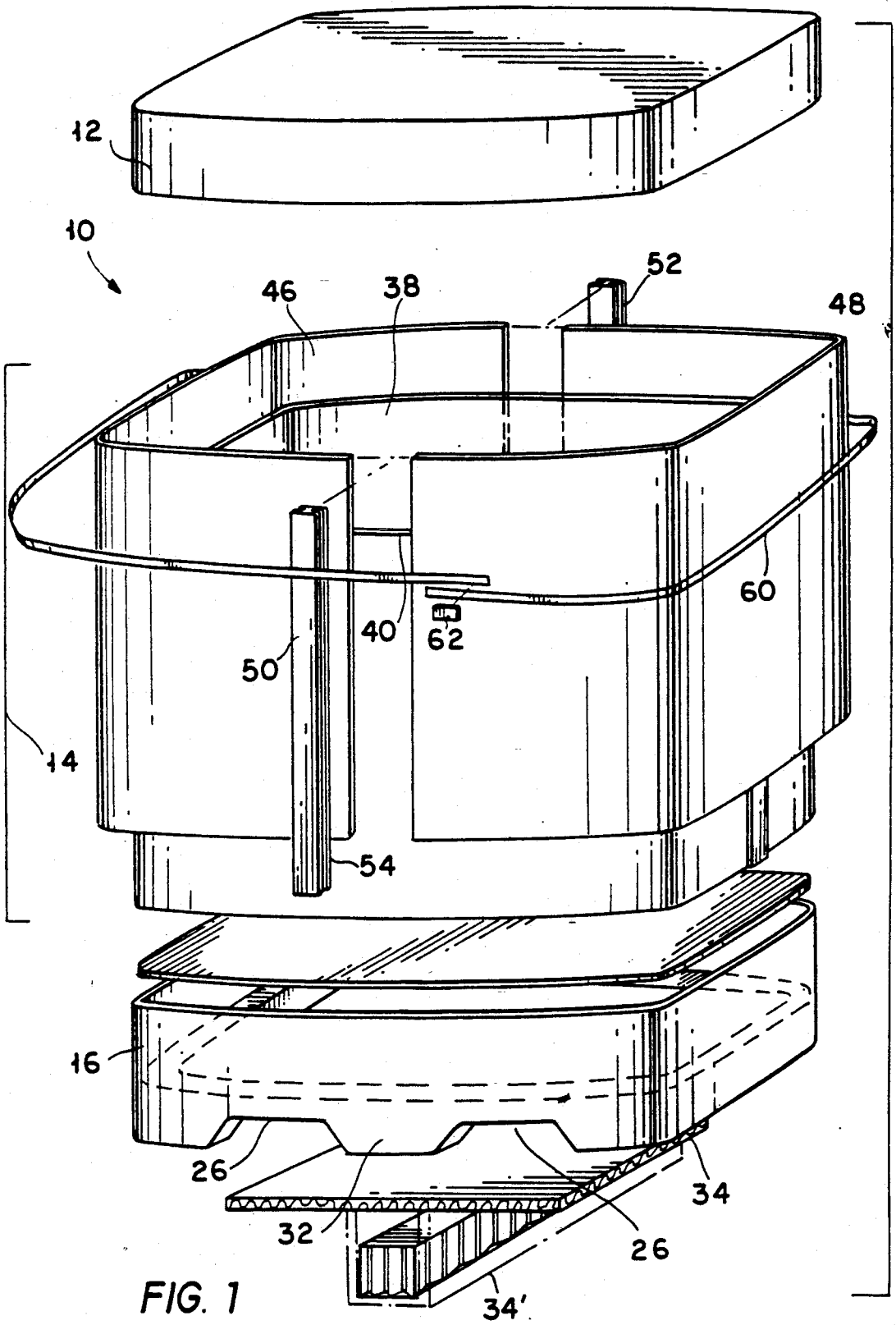
FIG. 1 shows an exploded view of a container constructed in accordance with this invention.

Referring now to the drawings, a container 10 constructed in accordance with this invention includes a top cap 12, a tubular body 14 and a bottom 16. Except as otherwise noted, the elements which make up container 10 are made of a fibrous material such as paper, cardboard etc. Moreover, each element may consist of a single fibrous layer or several layers laminated together.

Figure 4:
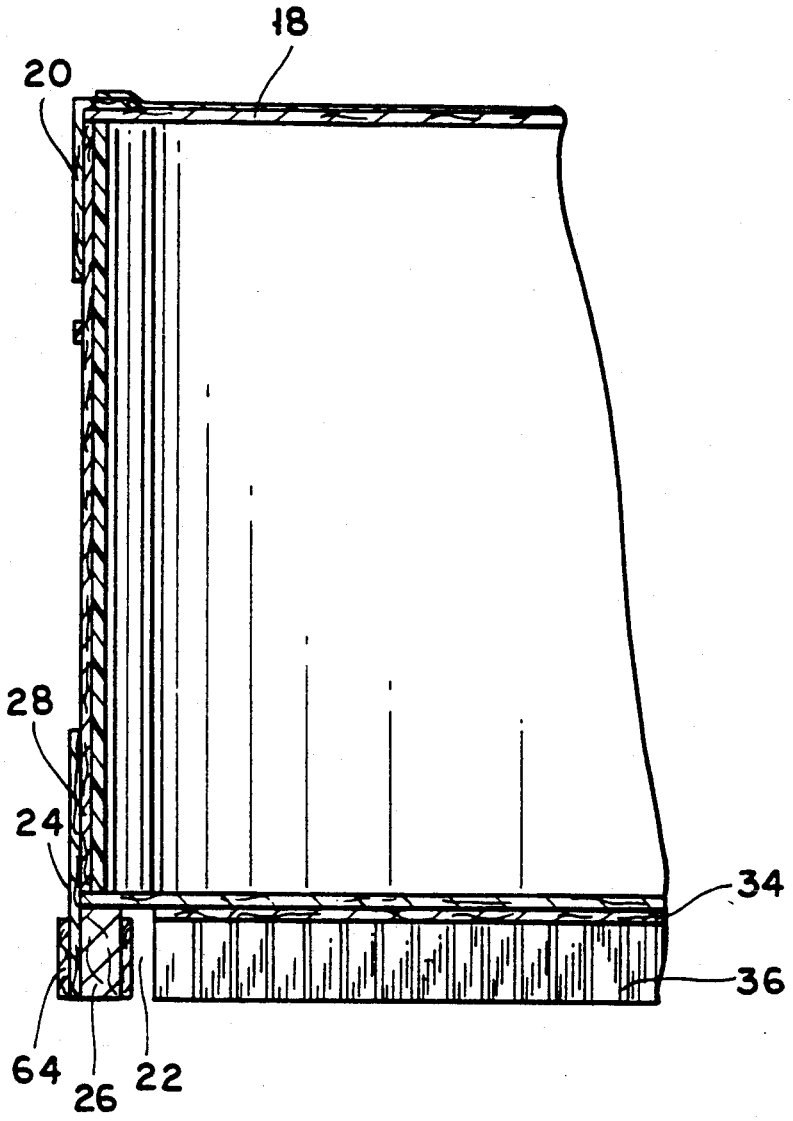
FIG. 4 shows a partial side-sectional view of the container as shown in FIG. 3 taken along lines 4—4.

As shown in FIG. 4, cap 12 consists of a substantially flat plate 18 peripherally surrounded by, and adhesively joined to, a downwardly extending upper skirt 20. Similarly, bottom 16 consists of a flat plate 22 surrounded peripherally by a lower skirt 24. Importantly, skirt 24 extends above and below plate 22. An inner ring 26 is adhesively joined to the skirt 24 to reinforce the bottom of the container, and to provide a ledge 28. Ledge 28 supports plate 22. The skirt 24 and plate 22 may be shaped and constructed to form an interference fit therebetween to hold the plate 22 in place. Alternatively, or in addition, plate 22 may be secured to skirt 24 and ring 26 by an adhesive material.

Figure 3:
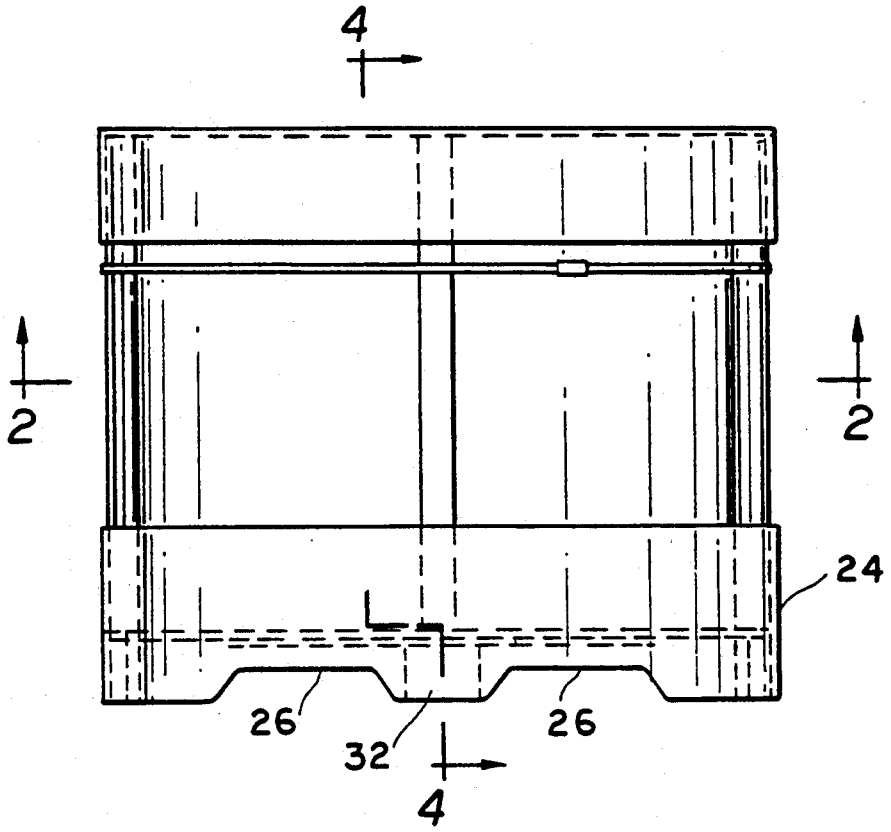
FIG. 3 shows a side elevational view of the container of FIG. 1.

As shown in FIGS. 1 and 3, skirt 24 and ring 26 are provided with several cutouts 30 separated by tabs 32. A reinforcing flat member 34 is secured by an adhesive material to the bottom of plate 22. In addition, extending along two opposed sides of the skirt 24, preferably behind tab 32, there is provided a strut 36 secured to member 34. Strut 36 may be made of polystyrene or another plastic "honey-comb like" material which is light enough so as not to add to the weight of the container 10, yet strong enough to insure that the bottom plate 22 does not buckle when the container is filled. Preferably the strut 36 extends downwardly so that it is even with the bottom of skirt 24. Alternatively, the member 34 may be shaped to form a channel 34' for housing strut 36 as indicated in FIG. 1 by the dotted lines.

Body 14 preferably consists of two sections, although for smaller and/or lighter containers a single section will be sufficient. The inner section consists of two U-shaped wall portions 38, 40 preferably having identical shapes and dimensions to reduce manufacturing costs. The two sections are placed face-to-face and are joined by connectors 42, 44 to form a continuous inner sidewall.

Similarly, the outer section consists of two U-shaped wall portions 46, 48 also joined by connectors 50, 52. Preferably, connectors are elongated members with two parallel side grooves as at 54 to define an H-shaped cross-section. These connectors may be made of a plastic material, for example by molding. Grooves 54 are shaped and dimensioned to form an interference fit with the vertical edges of the wall portions 38, 40, 46, 48, so that the body 14 may be assembled and disassembled easily without any special tools, by merely pressing the wall portions with their edges into the grooves of the connectors. Wall portions 46, 48 are slightly larger than wall portions 38, 40 so that they can be formed into an outer section which can surround the inner section.

Figure 2:
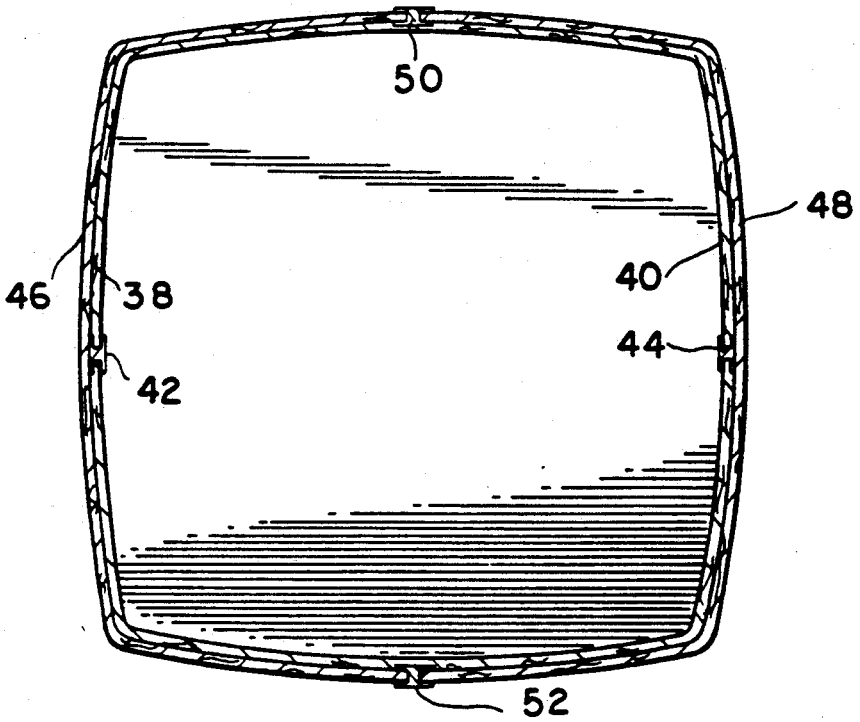
FIG. 2 shows a sectional view of the container of FIG. 1.

As shown more clearly in FIG. 2, the body 14 has a generally rectangular, or more particularly square shape with each sidewall being slightly curved, and with rounded corners having a smaller radius of curvature. As mentioned above, this shape is preferred because it provides a strong container and furthermore, if necessary, cap 12 can be stored temporarily inside the container without deformation. Importantly, the outer section of body 14 is rotated by 90° about a vertical axis with respect to the inner section so that the connectors 42, 44 joining the portions 38, 40 are not adjacent to the connectors 50, 52, joining portions 46, 48. This feature is provided to insure that the container remains intact when it falls on its side.

Preferably, body 14 is shaped and dimensioned so that it forms an interference fit with both the upper skirt 20 and an upwardly extending portion of lower skirt 24.

Advantageously, the elements of the container 10 as described above can be manufactured and shipped separately to the customer and stored without assembly. These elements take much less space than the assembled container and are much easier to handle. On skilled in the art will appreciate that several sidewall portions can be nested into each other for storage and/or shipping.

In order to put the container together, first the body 14 is assembled, by fitting the sidewalls into the connectors with the outer section being formed around or placed outside the inner section. Thereafter, the body 14 is pushed into the upper portion of lower skirt 24 preferably until the body 14 comes into contact with the plate 22. The container can now be filled either directly, or alternatively, a rigid or pliable liner may be put inside the container to hold a particular material. After the container is filled, top 12 is placed over and pushed down on the body so that the skirt 20 extends over the body 14. In this configuration, the top 12 and bottom 16 cooperate to hold body 14 together thereby, providing a strong container suitable for holding various types of heavy materials such as liquids, powders and so on. It has been found that containers can be made in this manner for holding 60 gallons or more. The strut 36 insures that bottom 16 does not collapse even under heavy loads. The cutouts 26 form a space in bottom 16 to allow the handling of a filled container by mechanized means such as a fork lift for example, for loading the container on a truck or for stacking.

In order to insure the integrity of the container, and especially to insure that the connectors do not open under internal or external forces, a strap 60 may be mounted on body 14 as shown. Once the strap 60 is wound around the body 14, its ends may be secured by a standard locking clip 62. The strap 60 may be made of plastic or maybe metallic.

Finally, since containers are frequently stored on surfaces which may be wet at times, and since fibrous materials may be weakened structurally when wet, the bottom 16 is protected by dipping it into a wax, or other water repellent material to form a coating, as shown somewhat exaggerated, at 64 (FIG. 4).

Obviously numerous modifications can be made to the invention without departing from its scope as defined in the appended claims.

What is claimed is:

1. A collapsible fiber container comprising:

a plurality of continuously curved relatively rigid molded fiber sidewalls;

connecting means for connecting said sidewalls to form a tubular body; and a bottom fiber member including a bottom skirt, said bottom skirt forming a bottom interference fit with said tubular body to reinforce said tubular body, a plate being joined to said bottom skirt and a strut being disposed under said plate.

2. The container of claim 1 wherein said skirt extends above and below said plate.

3. A collapsible container comprising:

a plurality of continuously curved relatively rigid molded sidewalls, each sidewall being defined between two longitudinal edges;

an equal plurality to connectors for connecting said sidewalls by said edges to form a tubular body;

a top member including a top plate and a top skirt extending below said top plate and arranged and constructed to form an interference fit with said tubular body when said tubular body is telescopically joined to said top member and;

a bottom member including a bottom plate and a bottom skirt extending above said bottom plate and arranged and constructed to form an interference fit with said tubular body when said tubular body is telescopically joined to said bottom member, a reinforcing strut being attached to said bottom plate.

4. A collapsible container comprising:

a plurality of continuously curved relatively rigid molded sidewalls, each sidewall being defined between two longitudinal edges;

an equal plurality of connectors for connecting said sidewalls by said edges to form a tubular body;

a top member including a top plate and a top skirt extending below said top plate and arranged and constructed to form an interference fit with said tubular body when said tubular body is telescopically joined to said top member;

a bottom member including a bottom plate and a bottom skirt extending above said bottom plate and arranged and constructed to form an interference fit with said tubular body when said tubular body is telescopically joined to said bottom member;

said bottom skirt being peripherally joined to, and around, said bottom plate, said bottom skirt extending below said bottom plate, said bottom skirt having a bottom edge and is formed with cutouts extending from said bottom edge, sized and shaped for mechanized handling of said container.

5. The container of claim 4 further comprising a reinforcing strut attached to said bottom plate disposed between said cutouts.

6. A collapsible container comprising:

a plurality of continuously curved relatively rigid molded sidewalls, each sidewall being defined between two longitudinal edges;

an equal plurality of connectors for connecting said sidewalls by said edges to form a tubular body;

a top member including a top plate and a top skirt extending below said top plate and arranged and constructed to form an interference fit with said tubular body when said tubular body is telescopically joined to said top member; and a bottom member including a bottom plate and a bottom skirt extending above said bottom plate and arranged and constructed to form an interference fit with said tubular body when said tubular body is telescopically joined to said bottom member, said plurality of sidewalls includes a first set and second set of sidewalls, and said plurality of connectors includes a set of inner connectors and a set of outer connectors, said first set of sidewalls being joined by said inner connectors to form an inner section, and said second set of sidewalls being joined by said outer connectors to form an outer section, said inner section being telescopically disposed within said outer section to form said tubular body.

7. The container of claim 6 wherein each of said first and second sets of sidewalls consist of two u-shaped sidewalls.

8. The container of claim 7 wherein said inner section being arranged within said outer section with said inner connectors being angularly offset from said outer connectors.

* * * * *